US011183766B2

(12) United States Patent
Jia

(10) Patent No.: US 11,183,766 B2
(45) Date of Patent: Nov. 23, 2021

(54) ANTENNA MODULE AND ELECTRONIC DEVICE

(71) Applicant: GUANGDONG OPPO MOBILE TELECOMMUNICATIONS CORP., LTD., Guangdong (CN)

(72) Inventor: Yuhu Jia, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 0 days.

(21) Appl. No.: 16/833,216

(22) Filed: Mar. 27, 2020

(65) Prior Publication Data

US 2020/0335869 A1 Oct. 22, 2020

(30) Foreign Application Priority Data

Apr. 19, 2019 (CN) ..... 201910316178.X

(51) Int. Cl.
*H01Q 3/36* (2006.01)
*H01Q 9/04* (2006.01)
(Continued)

(52) U.S. Cl.
CPC ..... *H01Q 9/045* (2013.01); *H01Q 1/38* (2013.01); *H01Q 5/30* (2015.01); *H01Q 9/0414* (2013.01)

(58) Field of Classification Search
CPC ..... H01Q 9/045; H01Q 5/30
(Continued)

(56) References Cited

U.S. PATENT DOCUMENTS 6,636,726 B1 * 10/2003 Erhage ..... H01Q 3/36 342/159
2007/0052587 A1 3/2007 Cheng
(Continued)

FOREIGN PATENT DOCUMENTS

CN 102280699 12/2011
CN 203760674 8/2014
(Continued)

OTHER PUBLICATIONS

PCT, International Search Report for Application No. PCT/CN2020/082117, dated Jun. 30, 2020.
(Continued)

*Primary Examiner* — Peguy Jean Pierre
(74) *Attorney, Agent, or Firm* — Hodgson Russ LLP

(57) ABSTRACT

An antenna module is provided. The antenna module includes a dielectric substrate, a first insulating layer, a stacked patch antenna, a ground layer, a second insulating layer, and a feeding structure. The dielectric substrate includes a first surface and a second surface opposite the first surface. The first insulating layer is disposed on the first surface of the dielectric substrate. The stacked patch antenna includes a first antenna radiator disposed on a side of the first insulating layer away from the dielectric substrate and a second antenna radiator disposed between the first insulating layer and the dielectric substrate. A projection of the first antenna radiator on the dielectric substrate at least partially overlaps with a projection of the second antenna radiator on the dielectric substrate. The ground layer is disposed on the second surface of the dielectric substrate, and the ground layer defines at least one slot.

19 Claims, 10 Drawing Sheets

(51) Int. Cl.
*H01Q 5/30* (2015.01)
*H01Q 1/38* (2006.01)

(58) Field of Classification Search
USPC ..... 343/700 MS
See application file for complete search history.

(56) References Cited

U.S. PATENT DOCUMENTS

| | | | | |
|---|---|---|---|---|
| 2011/0248890 | A1 | 10/2011 | Lee et al. | |
| 2016/0094091 | A1 | 3/2016 | Shin et al. | |
| 2017/0256847 | A1 | 9/2017 | Vollmer et al. | |
| 2018/0159203 | A1* | 6/2018 | Baks | H01Q 1/2283 |
| 2019/0058252 | A1 | 2/2019 | Kuo et al. | |
| 2019/0103682 | A1 | 4/2019 | Thai et al. | |

FOREIGN PATENT DOCUMENTS

| | | |
|---|---|---|
| CN | 105552550 | 5/2016 |
| CN | 106099354 | 11/2016 |
| CN | 207052755 | 2/2018 |
| CN | 108539395 | 9/2018 |
| CN | 108832288 | 11/2018 |
| CN | 109119768 | 1/2019 |
| CN | 109301472 | 2/2019 |
| EP | 3401998 | 11/2018 |
| JP | H0951224 | 2/1997 |

OTHER PUBLICATIONS

Khan et al., "Multi band Frequency Reconfigurable Dielectric Resonator Antenna for multiple wireless application", 2019 2nd International Conference on Communication, Computing and Digital systems (C-CODE), Apr. 4, 2019.

EPO, Extended European search report for EP Application No. 20166430.7, dated Sep. 4, 2020.

Tze-Hsuan Chang et al., "Compact Multi-Band H-Shaped Slot Antenna", IEEE Transactions on Antennas and Propagation, vol. 61, No. 8, Aug. 8, 2013.

3rd Generation Partnership Project; Technical Specification Group Radio Access network; NR; User Equipment (UE) radio transmission and reception; Part 2: Range 2 Standalone (Release 16); 3GPP TS 38.101-2 V16 4.0, Jun. 2020.

3rd Generation Partnership Project; Technical Specification Group Radio Access Network; Study on new radio access technology: Radio Frequency (RF) and co-existence aspects (Release 14), 3GPP TR 38.803 V14.2.0, Sep. 2017.

IPI, Office Action for IN Application No. 202014014226, dated Jul. 9, 2021.

SIPO, First Office Action for CN Application No. 201910316178.X, dated Mar. 29, 2021.

* cited by examiner

ANTENNA MODULE AND ELECTRONIC DEVICE

CROSS-REFERENCE TO RELATED APPLICATION

This application claims priority to Chinese Patent Application No. 201910316178. X, filed Apr. 19, 2019, the entire disclosure of which is incorporated herein by reference.

TECHNICAL FIELD

This disclosure relates to the technical field of antennas, and in particular, to an antenna module and an electronic device.

BACKGROUND

Generally, an antenna is in a form of patch antenna or dipole antenna, a radio frequency integrated circuit (RFIC) is packaged by a flip-chip process, and the antenna and the RFIC are interconnected by an integrated circuit substrate process or a high density interconnect (HDI) process. Due to limitations in impedance characteristics and other factors, a frequency band covered by an existing microstrip patch antenna has a relatively narrow range.

SUMMARY

According to a first aspect, an antenna module is provided according to the present disclosure. The antenna module includes a dielectric substrate, a first insulating layer, a stacked patch antenna, a ground layer, a second insulating layer, and a feeding structure. The dielectric substrate includes a first surface and a second surface opposite the first surface. The first insulating layer is disposed on the first surface of the dielectric substrate. The stacked patch antenna includes a first antenna radiator disposed on a side of the first insulating layer away from the dielectric substrate and a second antenna radiator disposed between the first insulating layer and the dielectric substrate. A projection of the first antenna radiator on the dielectric substrate at least partially overlaps with a projection of the second antenna radiator on the dielectric substrate. The ground layer is disposed on the second surface of the dielectric substrate, and the ground layer defines at least one slot. The second insulating layer is disposed on a side of the ground layer away from the dielectric substrate. The feeding structure is disposed on a side of the second insulating layer away from the ground layer. The feeding structure is configured to feed the stacked patch antenna via the at least one slot to excite the first antenna radiator to resonate in a first frequency band and excite the second antenna radiator to resonate in a second frequency band.

According to a second aspect, an antenna module is provided. The antenna module includes a dielectric substrate, a first insulating layer, a stacked patch antenna, a ground layer, a second insulating layer, and a feeding structure. The dielectric substrate includes a first surface and a second surface opposite the first surface. The first insulating layer is disposed on the first surface of the dielectric substrate. The stacked patch antenna includes a first antenna radiator disposed on a side of the first insulating layer away from the dielectric substrate, and a second antenna radiator disposed between the first insulating layer and the dielectric substrate, where a projection of the first antenna radiator on the dielectric substrate at least partially overlaps with a projection of the second antenna radiator on the dielectric substrate. The ground layer is disposed on the second surface of the dielectric substrate, and the ground layer defines at least one slot. The slot includes a first portion, a second portion, and a connection portion connected between the first portion and the second portion, and the first portion and the second portion are different in size. The connection portion is perpendicular to the first portion and the second portion respectively. The second insulating layer is disposed on a side of the ground layer away from the dielectric substrate. The feeding structure is disposed on a side of the second insulating layer away from the ground layer. The feeding structure has a feeding trace extending in a direction perpendicular to the first portion and the second portion, and the feeding structure is configured to feed the stacked patch antenna via the at least one slot to enable the first antenna radiator to resonate in a first frequency band, a second frequency band, and a third frequency band.

According to a third aspect, an electronic device is further provided. The electronic device includes a casing and an antenna module, and the antenna module is disposed within or on the casing. The antenna module includes a dielectric substrate, a first insulating layer, a stacked patch antenna, a ground layer, a second insulating layer, and a feeding structure. The dielectric substrate includes a first surface and a second surface opposite the first surface. The first insulating layer is disposed on the first surface of the dielectric substrate. The stacked patch antenna includes a first antenna radiator disposed on a side of the first insulating layer away from the dielectric substrate, and a second antenna radiator disposed between the first insulating layer and the dielectric substrate, where a projection of the first antenna radiator on the dielectric substrate at least partially overlaps with a projection of the second antenna radiator on the dielectric substrate. The ground layer is disposed on the second surface of the dielectric substrate, and the ground layer defines at least one slot. The second insulating layer is disposed on a side of the ground layer away from the dielectric substrate. The feeding structure is disposed on a side of the second insulating layer away from the ground layer. The feeding structure is configured to feed the stacked patch antenna via the at least one slot to excite the first antenna radiator to resonate in a first frequency band and excite the second antenna radiator to resonate in a second frequency band.

BRIEF DESCRIPTION OF THE DRAWINGS

To describe technical solutions of the present disclosure or the related art more clearly, the following briefly introduces the accompanying drawings required for describing the implementations or the related art. Apparently, the accompanying drawings in the following description merely illustrate some implementations of the present disclosure. Those of ordinary skill in the art may also obtain other obvious variations based on these accompanying drawings without creative efforts.

DETAILED DESCRIPTION

The technical solutions in the implementations of the present disclosure are clearly and completely described in the following with reference to the accompanying drawings in the implementations of the present disclosure. Apparently, the described implementations are merely a part of rather than all the implementations of the present disclosure. All other implementations obtained by those of ordinary skill in the art based on the implementations of the present disclosure without creative efforts are within the scope of the present disclosure.

In this specification, the description with reference to terms such as "one implementation", "some implementations", "exemplary implementations", "examples", "specific examples", or "some examples" means specific features, structures, materials, or characteristics described in combination with the implementations or examples are included in at least one implementation or example of the present disclosure. In this specification, the schematic representations of the above terms do not necessarily refer to the same implementation or example. Furthermore, the specific features, structures, materials, or characteristics described may be combined in any suitable manner in any one or more implementations or examples.

Figure 1:
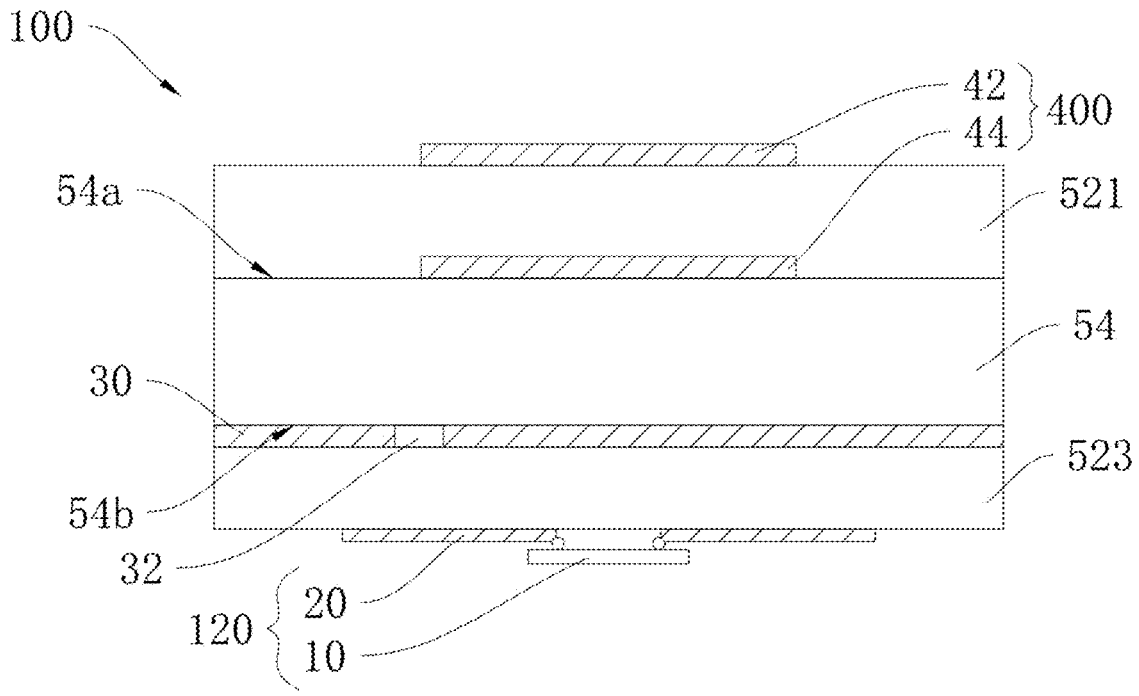
FIG. 1 is a schematic structural view illustrating a stacked patch antenna of an antenna module according to a first implementation of the present disclosure.

FIG. 1 is a schematic structural view illustrating a stacked patch antenna of an antenna module 100 according to a first implementation of the present disclosure. In this implementation, the antenna module 100 includes a dielectric substrate 54, a first insulating layer 521, a stacked patch antenna 400, a ground layer 30, a second insulating layer 523, and a feeding structure 120. In an implementation, the dielectric substrate 54 includes a first surface 54*a* and a second surface 54*b* opposite the first surface 54*a*. The first insulating layer 521 is disposed on the first surface 54*a* of the dielectric substrate 54. The stacked patch antenna 400 includes a first antenna radiator 42 disposed on a side of the first insulating layer 521 away from the dielectric substrate 54, and a second antenna radiator 44 disposed between the first insulating layer 521 and the dielectric substrate 54. A projection of the first antenna radiator 42 on the dielectric substrate 54 at least partially overlaps with a projection of the second antenna radiator 44 on the dielectric substrate 54. The ground layer 30 is disposed on the second surface 54*b* of the dielectric substrate 54, and the ground layer 30 defines at least one slot 32. The second insulating layer 523 is disposed on a side of the ground layer 30 away from the dielectric substrate 54. The feeding structure 120 is disposed on a side of the second insulating layer 523 away from the ground layer 30. The feeding structure 120 is configured to feed the stacked patch antenna 400 via the at least one slot 32 to excite the first antenna radiator 42 to resonate in a first frequency band and excite the second antenna radiator 44 to resonate in a second frequency band.

In the implementation, a feeding trace layer coupled to a radio frequency port of a radio frequency chip 10 (illustrated below) feeds the first antenna radiator 42 and the second antenna radiator 44 via a slot of the ground layer 30, such that the first antenna radiator 42 generates a millimeter wave signal in the first frequency band and the second antenna radiator 44 generates a millimeter wave signal in the second frequency band, and a millimeter wave signal in a third frequency band is further generated by coupling the slot 32 and the stacked patch antenna 400 (i.e., the first antenna radiator 42 and the second antenna radiator 44), thereby achieving a single-feeding port dual-band radiation antenna (the first frequency band and the third frequency band together form a continuous frequency band), such that the antenna module 100 can cover 5G millimeter wave frequency bands.

In an implementation, the feeding structure 120 includes the radio frequency chip 10 and a feeding trace 20. The radio frequency chip 10 is a dual-frequency radio frequency chip 10. The feeding trace 20 is coupled to the radio frequency port of the radio frequency chip 10. The feeding trace 20 is made of a conductive material such as metal. The ground layer 30, the first antenna radiator 42, and the second antenna radiator 44 are all metal layers. In an implementation, the first antenna radiator 42 and the second antenna radiator 44 are both patch antennas. In an implementation, both the first antenna radiator 42 and the second antenna radiator 44 may be circular or rectangular patch antennas. Alternatively, both the first antenna radiator 42 and the second antenna radiator 44 are in a square shape. Further, the first antenna radiator 42 and the second antenna radiator 44 form the stacked patch antenna 400. The slot 32 of the ground layer 30 extends through the ground layer 30 along a thickness direction of the ground layer 30. An excitation signal sent by the radio frequency chip 10 via the feeding trace 20 can be coupled to the slot 32 of the ground layer 30, and thus the ground layer 30 can also be called a slot coupling layer. It is appreciated that the thickness direction in this implementation refers to a direction in which various components of the antenna module 100 are stacked, that is, a direction in which the first antenna radiator 42, the second antenna radiator 44, the ground layer 30, and the radio frequency chip 10 are sequentially connected.

In this implementation, the first antenna radiator 42 and the second antenna radiator 44 are separated by the first insulating layer 521, the second antenna radiator 44 and the ground layer 30 are separated by the dielectric substrate 54, and the ground layer 30 and the feeding trace 20 are separated by the second insulating layer 523. The stacked patch antenna 400 is configured to couple with the slot 32 to resonate in a third frequency band. In an implementation, the radio frequency chip 10 is configured to couple with and feed the first antenna radiator 42 via the slot 32, so as to mainly generate a millimeter wave signal in the first frequency band (for example, the first frequency band with a center frequency of 28 GHz). The radio frequency chip 10 is configured to couple with and feed the second antenna radiator 44 via the slot 32, so as to mainly generate a millimeter wave signal in the second frequency band (for example, the second frequency band with a center frequency of 39 GHz). Further, a structure size of the slot 32 is designed to allow the radio frequency chip 10 to be coupled with the stacked patch antenna 400 via the slot 32 to generate a millimeter wave signal in the third frequency band (for example, the third frequency band with a center frequency of 25 GHz). The first frequency band and the third frequency band together form a continuous frequency band (for example, the first frequency band with the center frequency of 28 GHz and the third frequency band with the center frequency of 25 GHz together form a frequency band of 24 GHz to 29.8 GHz in which Si 1 is below 10 dB), thereby allowing the antenna module 100 to form a single-feeding port dual-band radiation antenna, such that the antenna module 100 can cover a frequency band in a relatively large range.

In this implementation, an orthographic projection of the first antenna radiator 42 on the ground layer 30 at least partially overlaps with the slot 32, and an orthographic projection of the second antenna radiator 44 on the ground layer 30 at least partially overlaps with the slot 32, such that the ability that the feeding structure 120 feeds the stacked patch antenna 400 via the slot 32 is enhanced. In another implementation, the slot 32 is adjacent to the orthographic projection of the first antenna radiator 42 on the ground layer 30, such that the ability that the feeding structure 120 feeds the stacked patch antenna 400 via the slot 32 is enhanced.

In this implementation, a structure of the antenna module 100 may be achieved by a high density interconnect (HDI) process or an integrated circuit (IC) substrate process.

In this implementation, the first insulating layer 521 and the second insulating layer 523 can also be called prepreg (PP) layers. The first insulating layer 521 and the second insulating layer 523 are made from high-frequency low-loss millimeter-wave materials. In a process of manufacturing and packaging the antenna module 100, the first insulating layer 521 and the second insulating layer 523 are used to connect various metal layers (for example, to connect the first antenna radiator 42 and the second antenna radiator 44, and to connect the ground layer 30 and the feeding trace 20). Further, the first insulating layer 521 and the second insulating layer 523 may be arranged between the ground layer 30 and the feeding trace 20. The first insulating layer 521 and the second insulating layer 523 may be formed after a prepreg between the first antenna radiator 42 and the second antenna radiator 44 is cured. In an implementation, the first insulating layer 521 and the second insulating layer 523 may be formed after a prepreg between the ground layer 30 and the feeding trace 20 and a prepreg between the first antenna radiator 42 and the second antenna radiator 44 are cured.

In this implementation, the dielectric substrate 54 can also be called a core layer. The dielectric substrate 54 is made from high-frequency low-loss millimeter wave materials. The dielectric substrate 54 acts as a primary bearing structure of the antenna module 100 and has great strength.

Figure 2:
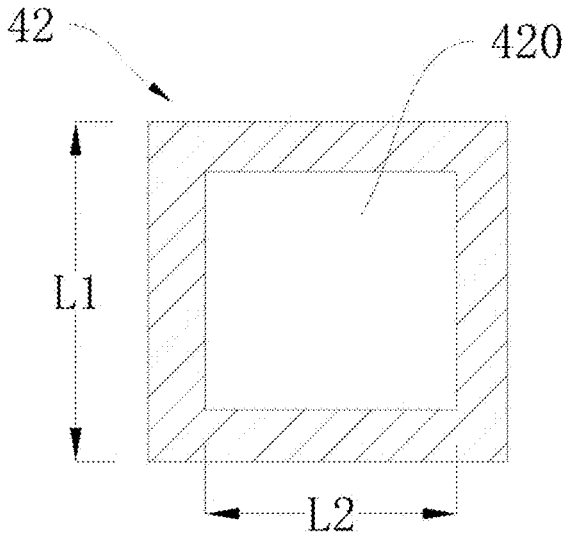
FIG. 2 is a schematic structural view illustrating a first antenna radiator according to an implementation.
Figure 3:
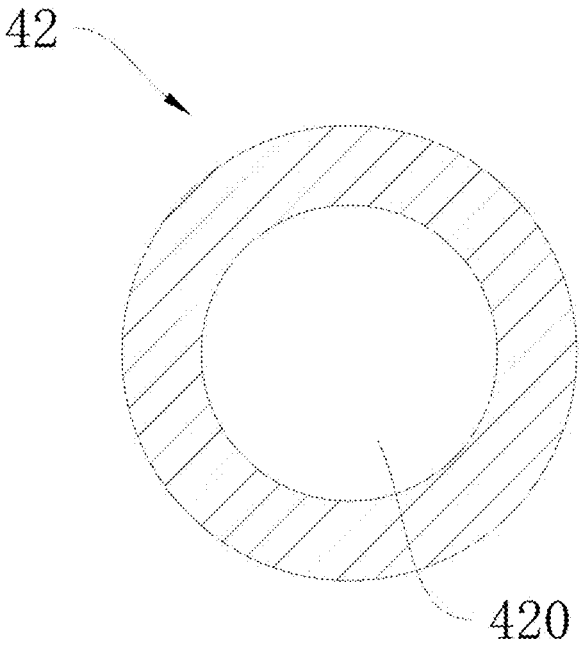
FIG. 3 is a schematic structural view illustrating a first antenna radiator according to another implementation.

FIG. 2 and FIG. 3 illustrate a schematic structural view illustrating the first antenna radiator 42. In this implementation, the first antenna radiator 42 defines a first through hole 420 extending through the first antenna radiator 42. In an implementation, the first through hole 420 extends through the first antenna radiator 42 along a thickness direction of the antenna radiator 42. By means of the first through hole 420, an influence generated by the first antenna radiator 42 and acted on electromagnetic waves radiated by the second antenna radiator 44 can be decreased. That is, part of the electromagnetic waves radiated by the second antenna radiator 44 passes through the first through hole 420 to be radiated outward, such that radiation effects of the second antenna radiator 44 can be improved, thereby improving radiation effects of the antenna module 100.

In an implementation, a geometric center of the first through hole 420 coincides with a geometric center of the first antenna radiator 42, and a cross section of the first antenna radiator 42 and the first through hole 420 are identical in shape. In an implementation, the cross section of the first antenna radiator 42 is rectangular when the first through hole 420 is rectangular, and the cross section of the first antenna radiator 42 is circular when the first through hole 420 is circular, that is, the first antenna radiator 42 is in a ring shape, for example, the first antenna radiator 42 is a square ring (as illustrated in FIG. 2) or an annular ring (as illustrated in FIG. 3), and each part of the first antenna radiator 42 is identical in dimension, such that the first antenna radiator 42 can have good radiation effects in all directions.

In an implementation, the second antenna radiator 44 is directly opposite to the first through hole 420 in the first antenna radiator 42, and the second antenna radiator 44 has a smaller size than the first antenna radiator 42. The influence generated by the first antenna radiator 42 and acted on the electromagnetic waves radiated by the second antenna radiator 44 can be further decreased due to that the second antenna radiator 44 is directly opposite to the first through hole 420, such that the second antenna radiator 44 can have relatively good radiation effects, and thus the antenna module 100 as a whole can have relatively good radiation effects.

Figure 4:
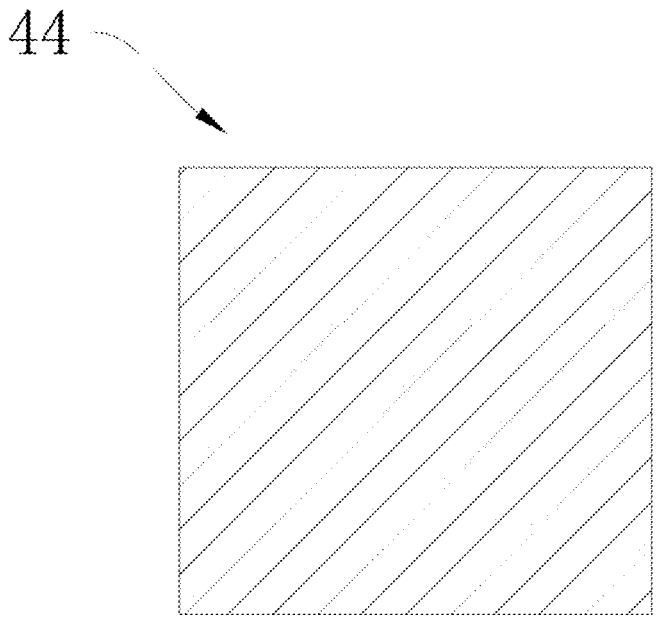
FIG. 4 is a schematic structural view illustrating a second antenna radiator according to an implementation.
Figure 5:
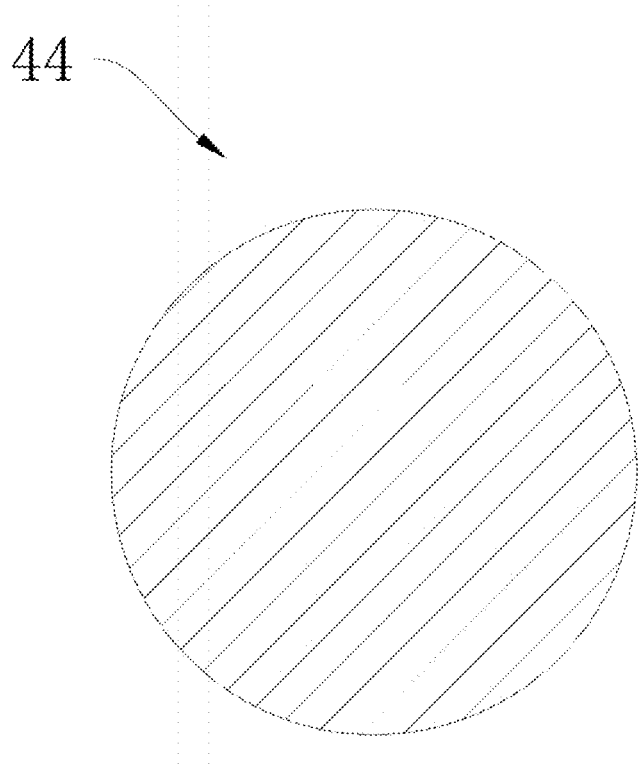
FIG. 5 is a schematic structural view illustrating a second antenna radiator according to another implementation.

In an implementation, a center of an orthographic projection of the second antenna radiator 44 on the first antenna radiator 42 coincides with a center of the first through hole 420, and an outer contour of the orthographic projection of the second antenna radiator 44 on the first antenna radiator 42 and the first through hole 420 are identical in shape. In other words, the second antenna radiator 44 and the first through hole 420 in the first antenna radiator 42 are identical in shape. In an implementation, FIG. 4 is a schematic structural view illustrating the second antenna radiator 44 according to an implementation. With reference to FIG. 2 and FIG. 4, a cross section of the second antenna radiator 44 is in a square shape when the first antenna radiator 42 is a square ring, that is, the second antenna radiator 44 and the first through hole 420 are all square in shape. FIG. 5 is a schematic structural view illustrating the second antenna radiator 44 according to another implementation. With reference to FIG. 3 and FIG. 5, the cross section of the second antenna radiator 44 is in a circular shape when the first antenna radiator 42 is in a ring shape, that is, the second antenna radiator 44 and the first through hole 420 are both circular in shape. The second antenna radiator 44 is directly opposite to the first through hole 420, and the second antenna radiator 44 and the first through hole 420 are identical in shape. Each part of an edge of the second antenna radiator 44 is at a same minimum distance from an edge of the first through hole 420, and thus the first antenna radiator 42 has the same effect on that each part of the edge of the second antenna radiator 44 radiates electromagnetic waves, the electromagnetic waves radiated by the second antenna radiator 44 in all directions have a same intensity, and the antenna module 100 can radiate electromagnetic waves well. In an implementation, the outer contour of the orthographic projection of the second antenna radiator 44 on the first antenna radiator 42 coincides with a contour of the first through hole 420. In other words, the second antenna radiator 44 and the first through hole 420 are identical in shape and size, thereby maximizing the size of the second antenna radiator 44 and improving the radiation ability of the second antenna radiator 44.

Figure 6:
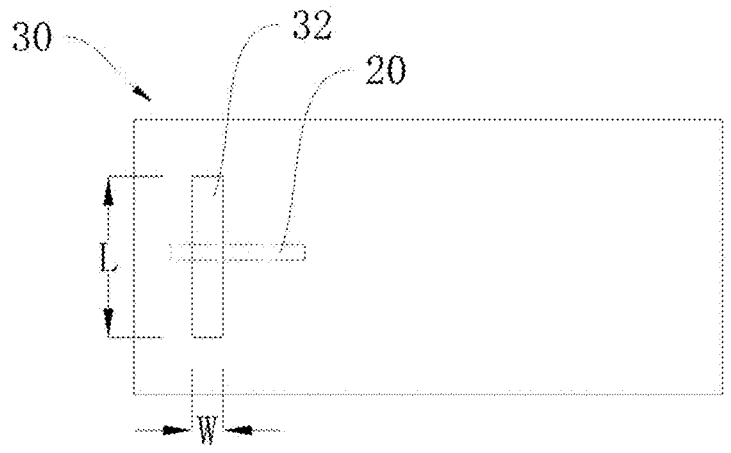
FIG. 6 is a schematic structural view illustrating a ground layer according to an implementation.

FIG. 6 is a schematic structural view illustrating the ground layer 30. With reference to FIG. 1 and FIG. 6, in this implementation, the slot 32 is not positioned at a geometric center of the ground layer 30. In an implementation, the slot 32 is offset from the geometric center of the ground layer 30 to enhance coupling effects. In an implementation, a geometric center of the radio frequency chip 10, the geometric center of the ground layer 30, a geometric center of the second antenna radiator 44, and a geometric center of the first antenna radiator 42 are positioned in line. That is, the geometric center of the radio frequency chip 10, the geometric center of the ground layer 30, the geometric center of the second antenna radiator 44, and the geometric center of the first antenna radiator 42 together define a center line of the antenna module 100. The slot 32 is positioned offset from the center line. Further, a distance of the slot 32 from the center line can be obtained based on a distance between the ground layer 30 and the feeding trace 20, a distance between the ground layer 30 and the first antenna radiator 42, and a distance between the ground layer 30 and the second antenna radiator 44.

In this implementation, an orthographic projection of the feeding trace 20 on the ground layer 30 is across the slot 32. In an implementation, dotted lines in FIG. 6 illustrate the projection of the feeding trace 20 disposed at a side of the slot 32 on the ground layer 30. As illustrated in FIG. 6, the feeding trace 20 extends across the slot 32 to improve the strength of coupling between the feeding trace 20 and the slot 32.

In an implementation, the orthographic projection of the feeding trace 20 on the ground layer 30 is rectangular. Further, the slot 32 is in a rectangular shape, and the orthographic projection of the feeding trace 20 on the ground layer 30 is perpendicular to the slot 32 in the rectangular shape. In this implementation, by means of changing the shape and size of the slot 32, an ability that the feeding trace 20 provides coupling feeding for the first antenna radiator 42 and the second antenna radiator 44 via the slot 32 can be changed, and thus the shape and size of the slot 32 can be designed to allow the radio frequency chip 10 to provide coupling feeding for the first antenna radiator 42 via the slot 32 to generate a millimeter wave signal in the first frequency band, and to provide coupling feeding for the second antenna radiator 44 via the slot 32 to generate a millimeter wave signal in the second frequency, and to further provide coupling feeding for the stacked patch antenna 400 to generate a millimeter wave signal in the third frequency band, accordingly the antenna module 100 is made to be the single-feeding port dual-band radiation antenna (the first frequency band and the third frequency band together form a continuous frequency band) and can cover a frequency band in a relatively large range.

Figure 7:
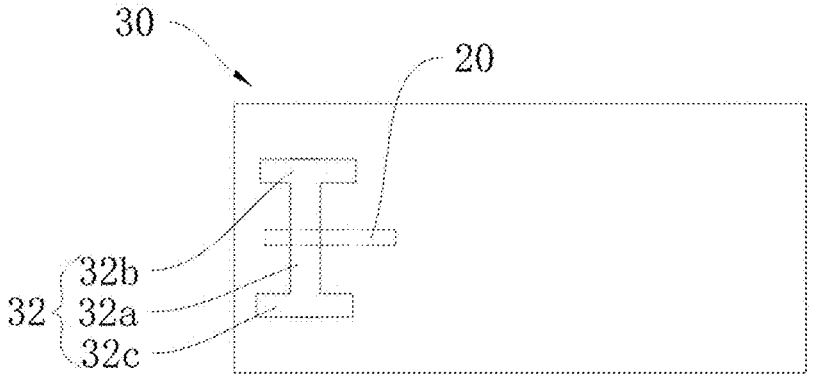
FIG. 7 is a schematic structural view illustrating a ground layer according to another implementation.

FIG. 7 illustrates a shape of the slot 32 according an implementation. In this implementation, the slot 32 is in an I-shape or an H shape. The slot 32 has a first portion 32*a*, a second portion 32*b*, and a third portion 32*c*. The second portion 32*b* and the third portion 32*c* are in communication with the first portion 32*a* respectively. The first portion 32*a* is perpendicular to the second portion 32*b* and the third portion 32*c* respectively. In an implementation, the first portion 32*a*, the second portion 32*b*, and the third portion 32*c* are all linear. The feeding trace 20 extends in a direction perpendicular to the first portion 32*a* of the slot 32. The slot 32 in the I-shape can enhance the strength of the coupling between the feeding trace 20 and the first antenna radiator 42 and the second antenna radiator 44 via the slot 32, thereby improving the radiation effects of the first antenna radiator 42 and the second antenna radiator 44. Further, the size of the slot 32 in the I-shape can be designed to allow the radio frequency chip 10 to provide coupling feeding for the first antenna radiator 42 via the slot 32 so as to excite the first antenna radiator 42 to resonate in the 28 GHz frequency band, to provide coupling feeding for the second antenna radiator 44 via the slot 32 so as to excite the second antenna radiator 44 to resonate in the 39 GHz frequency band, and to further provide coupling feeding for the stacked patch antenna 400 via the slot 32 so as to excite the stacked patch antenna 400 to resonate in the 25 GHz frequency band, accordingly the antenna module 100 is made to be the single-feeding port dual-band radiation antenna and can cover a frequency band in a relatively large range.

Figure 8:
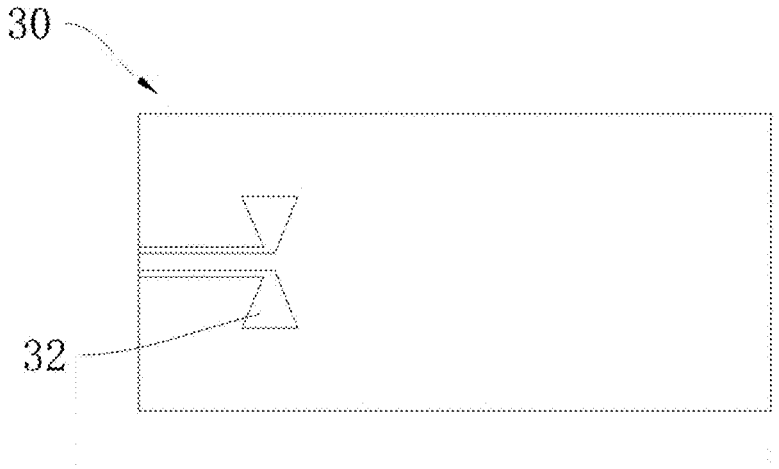
FIG. 8 is a schematic structural view illustrating a ground layer according to another implementation.

FIG. 8 illustrates a shape of the slot 32 according to an implementation. In this implementation, the slot 32 is in a bow-tie-like shape. The slot 32 extends to an edge of the ground layer 30. The slot 32 in the bow-tie-like shape can enhance the strength of coupling between the feeding trace 20 and the first antenna radiator 42 and the second antenna radiator 44 via the slot 32, thereby improving the radiation effects of the first antenna radiator 42 and the second antenna radiator 44. Further, the size of the slot 32 in the bow-tie-like shape can be designed to allow the radio frequency chip 10 to provide coupling feeding for the first antenna radiator 42 via the slot 32 so as to excite the first antenna radiator 42 to resonate in the 28 GHz frequency band, to provide coupling feeding for the second antenna radiator 44 via the slot 32 so as to excite the second antenna radiator 44 to resonate in the 39 GHz frequency band, and to further provide coupling feeding for the stacked patch antenna 400 via the slot 32 so as to excite the stacked patch antenna 400 to resonate in the 25 GHz frequency band, accordingly the antenna module 100 is made to be the single-feeding port dual-band radiation antenna and can cover a frequency band in a relatively large range.

The feeding trace 20 coupled to the radio frequency port of the radio frequency chip 10 feeds the first antenna radiator 42 and the second antenna radiator 44 via the slot 32 of the ground layer 30, such that the first antenna radiator 42 generates the millimeter wave signal in the first frequency band, the second antenna radiator 44 generates the millimeter wave signal in the second frequency band, and the millimeter wave signal in the third frequency band are further generated by coupling the slot 32 and the stacked patch antenna 400 (i.e., the first antenna radiator 42 and the second antenna radiator 44), thereby achieving the single-feeding port dual-band radiation antenna (the first frequency band and the third frequency band together form a continuous frequency band), such that the antenna module 100 can cover a radiation band in a relatively large range and cover 5G millimeter wave frequency bands.

Figure 9:
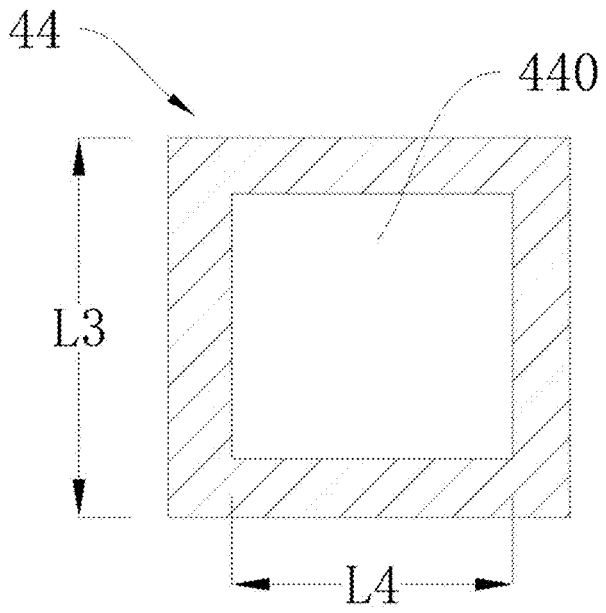
FIG. 9 is a schematic structural view illustrating a second antenna radiator of an antenna module according to a second implementation of the present disclosure.

FIG. 9 is a schematic structural view illustrating the second antenna radiator 44 of the antenna module 100 according to a second implementation of the present disclosure. The antenna module 100 provided in the second implementation of the present disclosure is substantially identical to the antenna module 100 provided in the first implementation, except that the second antenna radiator 44 in the second implementation defines a second through hole 440 extending through the second antenna radiator 44. In an implementation, the second through hole 440 extends through the second antenna radiator 44 along a thickness direction of the second antenna radiator 44. In this implementation, the second through hole 440 leads to a change in the shape of the second antenna radiator 44 and results in a change in a feeding path of the second antenna radiator 44, such that the second antenna radiator 44 can be made to be relatively small, thereby facilitating a miniaturization of the second antenna radiator 44. The reduction of the size of the second antenna radiator 44 allows the size of the first through hole 420 to be made to be relatively small, where the size of the first through hole 420 needs to be made to be larger than that of the second antenna radiator 44, and thus the size of the first antenna radiator 42 can also be reduced, thereby facilitating reducing the size of the whole antenna module 100.

In an implementation, a geometric center of the second through hole 440 coincides with a geometric center of the second antenna radiator 44, such that the second antenna radiator 44 has a uniform and symmetrical shape, and the electromagnetic waves radiated by the second antenna radiator 44 in all directions are uniform.

Figure 10:
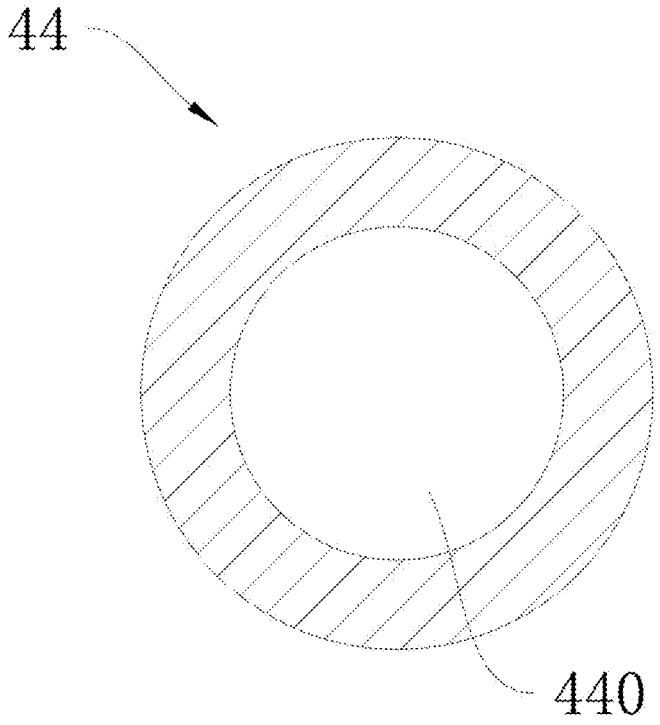
FIG. 10 is a schematic structural view illustrating a second antenna radiator according to another implementation.
Figure 11:
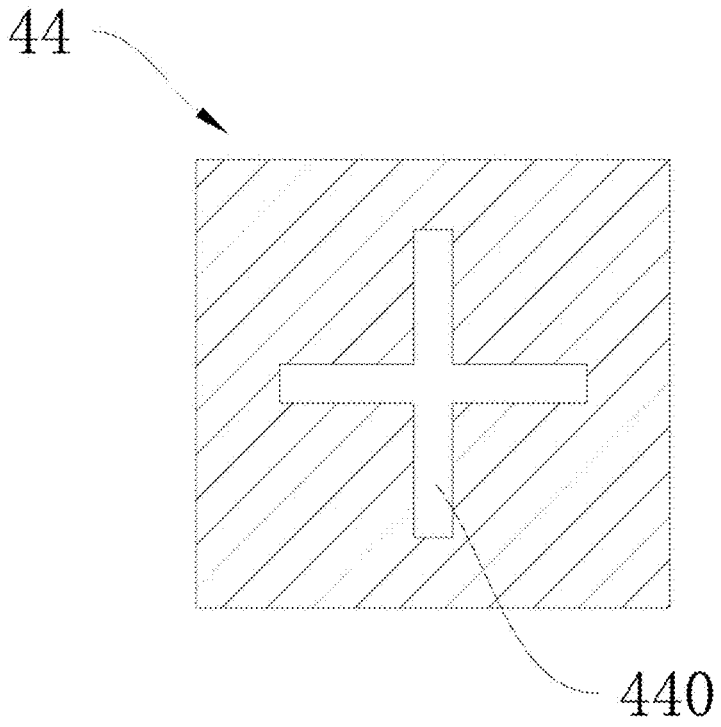
FIG. 11 is a schematic structural view illustrating a second antenna radiator according to another implementation.

FIGS. 9 to 11 illustrate several possible structures of the second antenna radiator 44. The second through hole 440 is in a circular shape, a square shape, or a cross shape. In an implementation, as illustrated in FIG. 9, a cross section of the second antenna radiator 44 is in a square shape, and the second through hole 440 is in a square shape, that is, the second antenna radiator 44 is a square ring. In an implementation, the first antenna radiator 42 cooperated with the second antenna radiator 44 may also be a square ring. As illustrated in FIG. 10, the cross section of the second antenna radiator 44 is in a circular shape, and the second through hole 440 is in a circular shape, that is, the second antenna radiator 44 is a circular ring. In an implementation, the first antenna radiator 42 cooperated with the second antenna radiator 44 may also be a circular ring. As illustrated in FIG. 11, the cross section of the second antenna radiator 44 is in a square shape, and the second through hole 440 is in a cross shape. In an implementation, the first antenna radiator 42 cooperated with the second antenna radiator 44 may also be a square ring. It is noted that the structure of the second antenna radiator 44 includes but is not limited to the above several possible structures.

Figure 12:
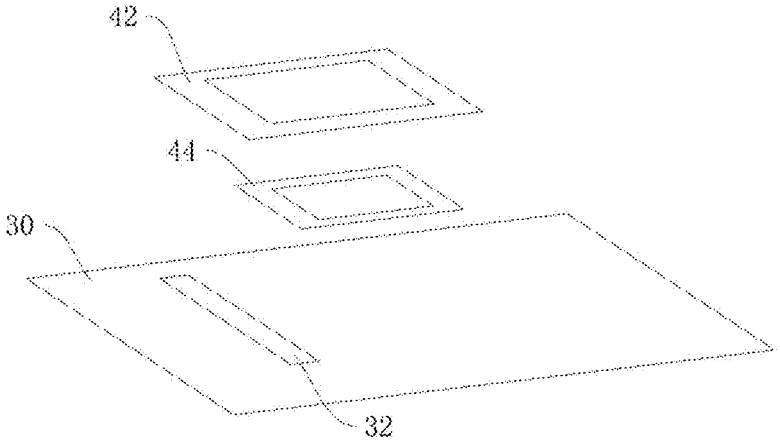
FIG. 12 is a schematic view illustrating an antenna module according to an implementation.

Referring to FIG. 12, the first antenna radiator 42 is a square ring (see FIG. 2), the second antenna radiator 44 is a square ring (see FIG. 9), and the slot 32 is rectangle (see FIG. 6). The S11 graph of the antenna module 100 is described below with reference to FIG. 12. It is noted that, a prepreg layer 52 and the dielectric substrate 54 are omitted in FIG. 12 for convenience. In an implementation, the prepreg layer 52 is in a form of the insulating layer including the first insulating layer 521 and the second insulating layer 523.

In an implementation, the thickness of the dielectric substrate 54 is 0.5 mm, and the total thickness of the insulating layer 52 between the first antenna radiator 42 and the second antenna radiator 44 is 0.3 mm. The dielectric substrate 54 and the insulating layer 52 are made from high-frequency low-loss millimeter wave materials with a dielectric constant (Dk) of 3.4 and a dissipation factor (Df) of 0.004. As illustrated in FIG. 2, the first antenna radiator 42 has an outer side length L1 of 1.8 mm and an inner side length L2 of 1.6 mm. As illustrated in FIG. 9, the second antenna radiator 44 has an outer side length L3 of 1.4 mm and an inner side length L4 of 0.8 mm. As illustrated in FIG. 6, the rectangular slot 32 has a length L of 2.75 mm and a width W of 0.15 mm.

Figure 13:
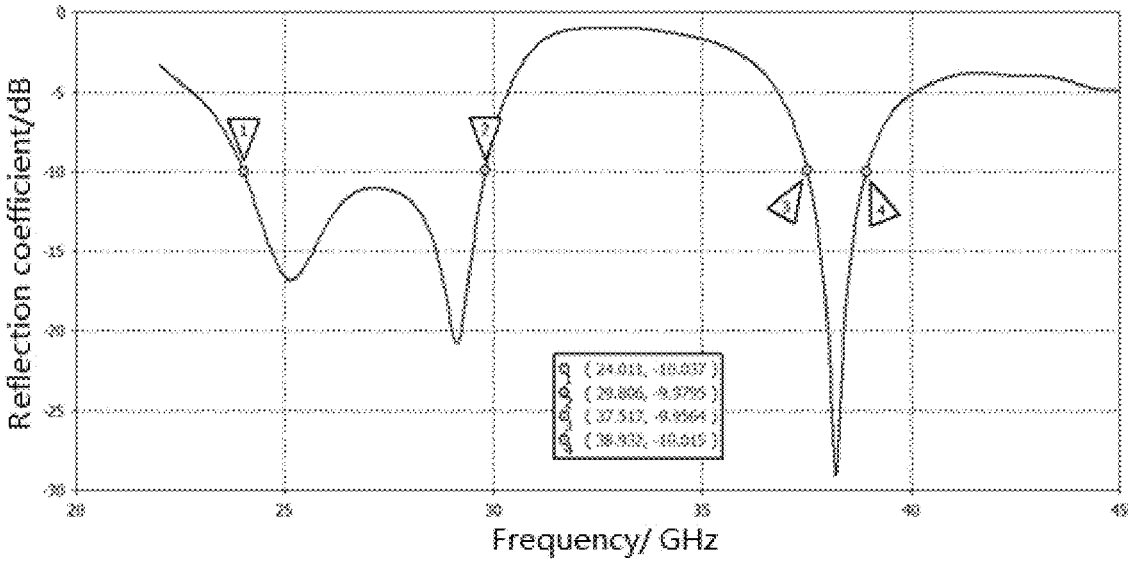
FIG. 13 illustrates an S11 graph of an antenna module.

FIGS. 13 to 16 illustrate calculation results obtained by simulation. FIG. 13 illustrates an S11 graph of the antenna module 100. In FIG. 13, the horizontal axis represents the frequency of a millimeter wave signal in units of GHz, and the vertical axis represents a return loss S11 in units of dB. In FIG. 13, the frequency of the millimeter wave signal corresponding to the lowest point in the S11 curve indicates that when the antenna module 100 operates at this frequency, the millimeter wave signal has the smallest return loss. That is, the frequency corresponding to the lowest point in the S11 curve is the center frequency of the millimeter wave signal. A frequency range in the S11 curve corresponding to a return loss less than or equal to −10 dB is operated as a radiation frequency band of the antenna module 100 that meets the requirements. In FIG. 13, the millimeter wave signal in the first frequency band radiated by the first antenna radiator 42 has a center frequency of 28 GHz, the millimeter wave signal in the second frequency band radiated by the second antenna radiator 44 has a center frequency of 39 GHz, and the millimeter wave signal in the third frequency band is further generated by coupling the slot 32 and the stacked patch antenna 400 and has a center frequency of 25 GHz. In FIG. 13, triangle marks with reference numbers of 1, 2, 3, and 4 indicate points in the S11 curve corresponding to a return loss S11 of approximately −10 dB, and thus, a frequency range of the S11 curve corresponding to a return loss less than −10 dB includes a range of 24 GHz-29.8 GHz (formed by combining the first frequency band and the second frequency band) and a range of 37.5 GHz-38.9 GHz.

With accordance to the protocol of the 3GPP 38.101, frequency bands for 5G NR are mainly separated into two different frequency ranges: frequency range 1 (FR1) and frequency range 2 (FR2). The FR1 band has a frequency range of 450 MHz-6 GHz, and also knows as the "sub-6 GHz" band. The FR2 band has a frequency range of 24.25 GHz-52.6 GHz, and also commonly known as millimeter wave (mmWave). 3GPP specifies that the 5G millimeter wave frequency bands include bands n257 (26.5 GHz-29.5 GHz), n258 (24.25 GHz-27.5 GHz), n261 (27.5 GHz-28.35 GHz), and n260 (37 GHz-40 GHz). In FIG. 13, the frequency range of the S11 curve corresponding to the return loss less than −10 dB covers bands n257, n258, n261 and partially overlaps with band n260, thereby meeting the requirements of bands n257, n258, n261 and part of band n260 in 3GPP specifications.

Figure 14:
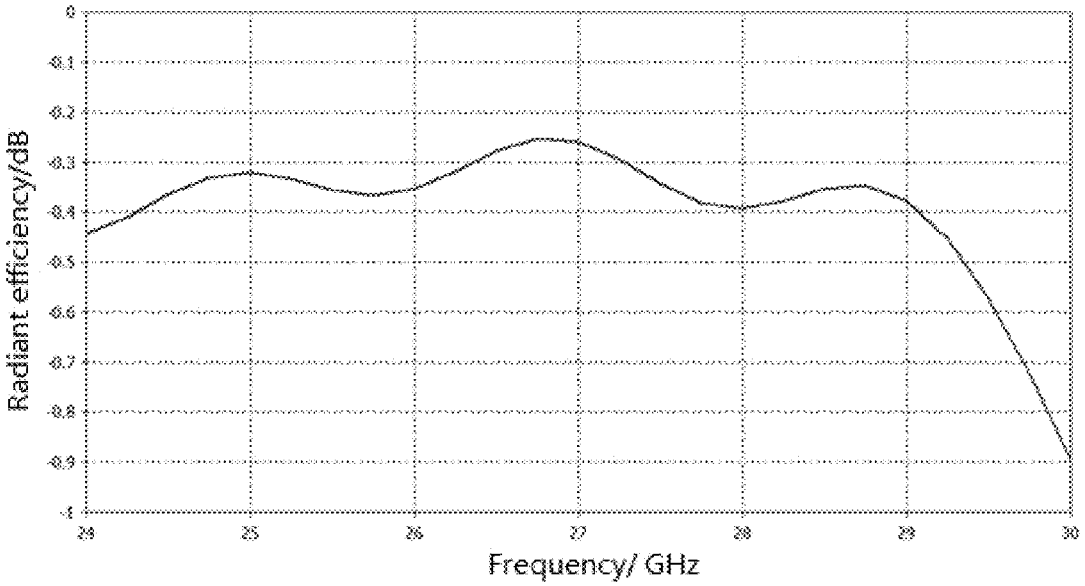
FIG. 14 illustrates an antenna efficiency graph of an antenna module in the 28 GHz band.
Figure 15:
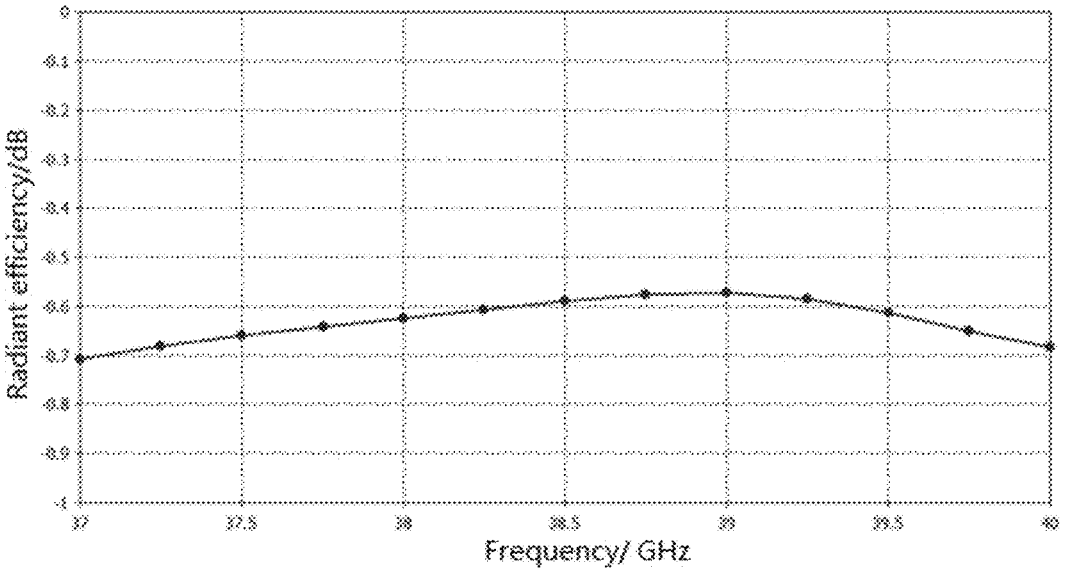
FIG. 15 illustrates an antenna efficiency graph of an antenna module in the 39 GHz band.
Figure 16:
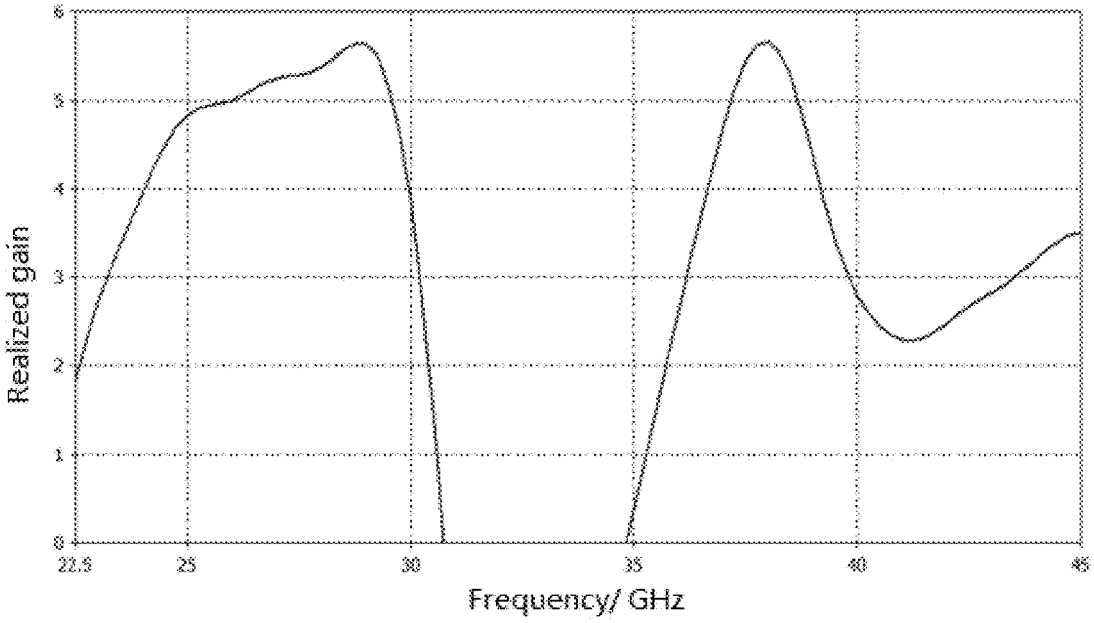
FIG. 16 illustrates a gain graph of the antenna module in the 22.5 GHz-45 GHz range.

FIG. 14 illustrates the antenna efficiency of the antenna module 100 at the 28 GHz band. FIG. 15 illustrates the antenna efficiency of the antenna module 100 at the 39 GHz band, and the antenna radiation efficiency is above 85% in the 3GPP frequency band. FIG. 16 illustrates a gain curve of the antenna module 100 in a frequency range of 22.5 GHz-45 GHz. As illustrated in FIG. 16, the antenna module 100 has a large gain in frequency ranges of 4 GHz-29.8 GHz and 37.5 GHz-38.9 GHz.

Figure 17:
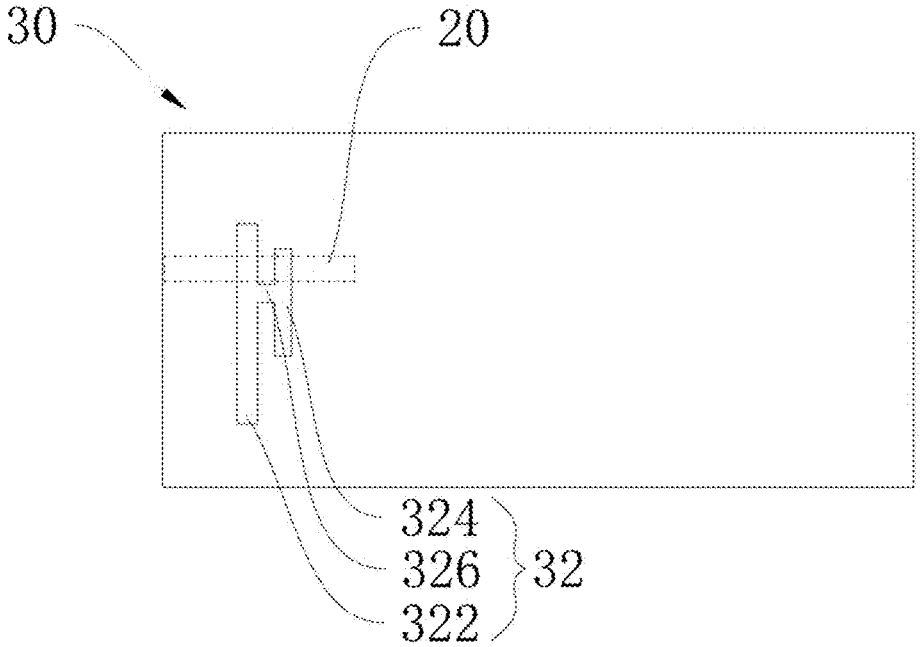
FIG. 17 is a schematic structural view illustrating a ground layer of an antenna module according to a third implementation of the present disclosure.

FIG. 17 is a schematic structural view illustrating the ground layer 30 of the antenna module 100 according to a third implementation of the present disclosure. The antenna module 100 provided in the third implementation of the present disclosure is substantially identical to the antenna module 100 provided in the second implementation, except that the structure of the slot 32 in the third implementation is different from that in the second implementation. In an implementation, the slot 32 in the third implementation includes a first portion 322, a second portion 324, and a connection portion 326 connected between the first portion 322 and the second portion 324. The first portion 322 and the second portion 324 are different in size. In an implementation, the first portion 322 is parallel to the second portion 324. In an implementation, a length of the first portion 322 is larger than that of the second portion 324. In an implementation, a width of the of the first portion 322 is larger than that of the second portion 324, and alternatively, the width of the first portion 322 is substantially equal to that of the second portion 324. In an implementation, a distance between the first portion 322 and the second portion 324 is less than the width of the first portion 322 and/or the width of the second portion 324, that is, a width of the connection portion 326 is less that the width of the first portion 322 or/and the width of the second portion 324. In an implementation, a geometric center of the connection portion 326 is offset from a geometric center of the first portion 322 and/or a geometric center of the second portion 324. In an implementation, the geometric center of the first portion 322, the geometric center of the second portion 324, and the geometric center of the ground layer 30 define a straight line, and the geometric center of the connection portion 326 is offset from the straight line. The connection portion 326 is perpendicular to the first portion 322 and the second portion 324 respectively. The feeding trace 20 is configured to provide coupling feeding for the first antenna radiator 42 and the second antenna radiator 44 via the first portion 322 and the second portion 324. Further, the feeding trace 20 extends in a direction perpendicular to the first portion 322 and the second portion 324. In this implementation, the first portion 322 and the second portion 324 are used to provide coupling feeding for the first antenna radiator 42 and the second antenna radiator 44 respectively, so that each of the first antenna radiator 42 and the second antenna radiator 44 can generate two resonances, thereby widening the frequency band covered by the antenna module 100. In this implementation, millimeter wave signals in high frequency range of 37 GHz-40 GHz are generated via the slot 32, thereby meeting the requirements of the 3GPP band n260 and supporting 3GPP full frequency band.

In an implementation, the orthographic projection of the feeding trace 20 on the ground layer 30 is across the first portion 322 and the second portion 324. In this implementation, dotted lines in FIG. 17 illustrate the projection of the feeding trace 20 disposed at a side of the slot 32 on the ground layer 30. As illustrated in FIG. 7, the feeding trace 20 is across the first portion 322 and the second portion 324 to improve the strength of coupling between the feeding trace 20 and the slot 32.

Figure 18:
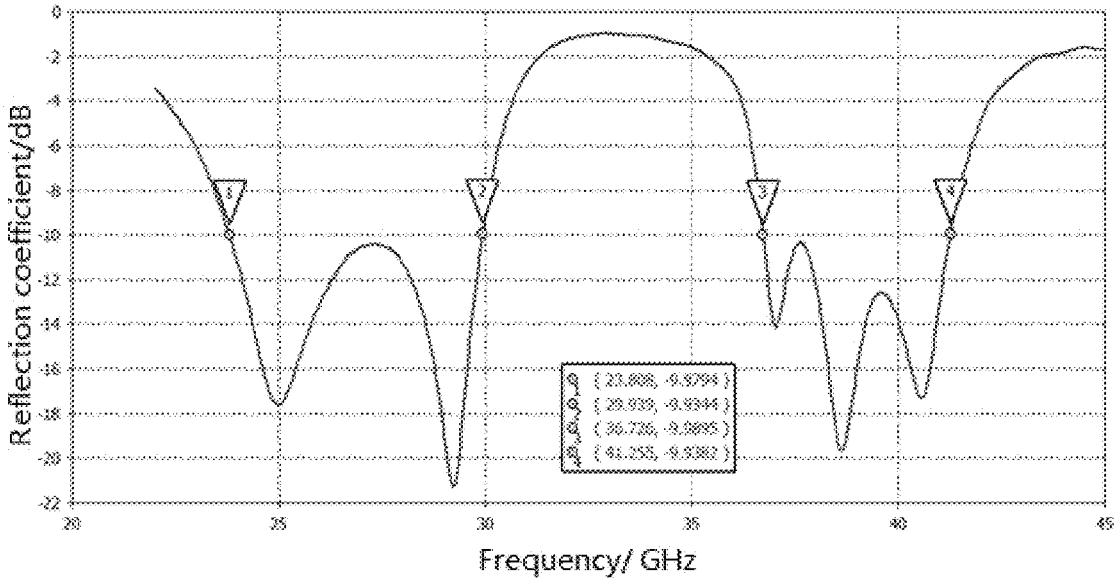
FIG. 18 illustrates an S11 graph of an antenna module.

An simulation built on the antenna module 100 with the ground layer 30 illustrated in FIG. 13, instead of the ground layer 30 illustrated in FIG. 12, is carried out to obtain the S11 graph of the antenna module 100 illustrated in FIG. 18. The horizontal axis represents the frequency of a millimeter wave signal in units of GHz, and the vertical axis represents a return loss S11 in units of dB. In FIG. 18, the frequency of the millimeter wave signal corresponding to the lowest point in the S11 curve indicates that when the antenna module 100 operates at this frequency, the millimeter wave signal has the smallest return loss. That is, the frequency corresponding to the lowest point in the S11 curve is the center frequency of the millimeter wave signal. A frequency range corresponding to a return loss less than or equal to −10 dB is operated as a radiation frequency band of the antenna module 100 that meets the requirements. In FIG. 18, triangle marks with reference numbers of 1, 2, 3, and 4 indicate points in the S11 curve corresponding to a return loss S11 of approximately −10 dB, and thus, a frequency range of the S11 curve corresponding to a return loss less than −10 dB includes a range of 24 GHz-29.8 GHz and a range of 36.7 GHz-41.2 GHz. With accordance to the protocol of the 3GPP 38.101, frequency bands for 5G NR are mainly separated into two different frequency ranges: FR1 band and FR2 band. The FR1 band has a frequency range of 450 MHz-6 GHz, and also knows as the "sub-6 GHz" band. The FR2 band has a frequency range of 24.25 GHz-52.6 GHz, and also commonly known as mmWave. 3GPP specifies that the 5G millimeter wave frequency bands include bands n257 (26.5 GHz-29.5 GHz), n258 (24.25 GHz-27.5 GHz), n261 (27.5 GHz-28.35 GHz), and n260 (37 GHz-40 GHz). In FIG. 18, the frequency range of the S11 curve corresponding to the return loss less than −10 dB covers bands n257, n258, n261 and partially overlaps with band n260, thereby meeting the requirements of bands n257, n258, n261 and part of band n260 in 3GPP specifications, that is, supporting the requirements of the full frequency band in 3GPP specifications.

Figure 19:
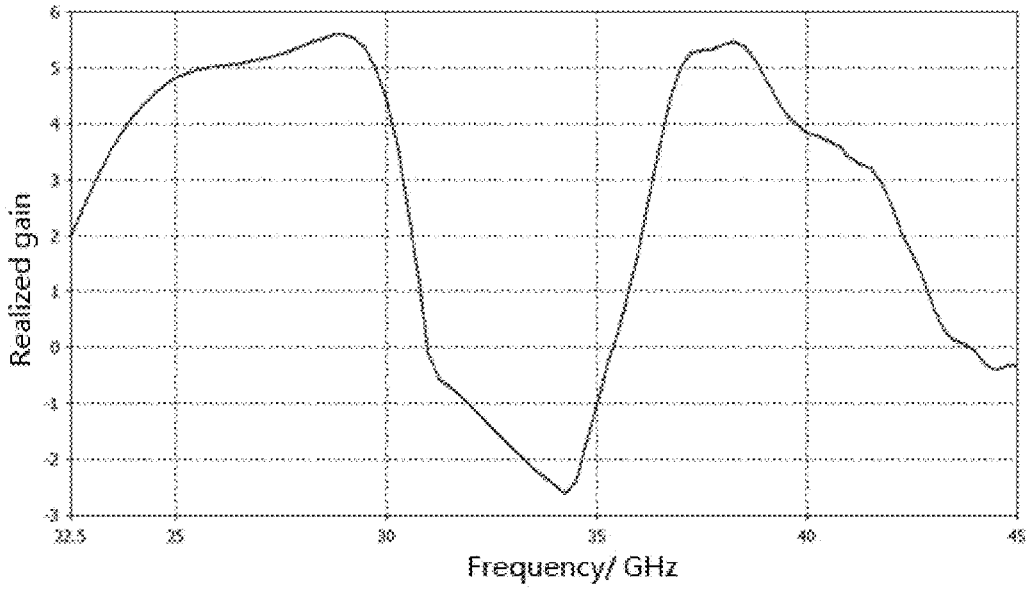
FIG. 19 illustrates a gain graph of an antenna module in a range of 22.5 GHz-45 GHz.

FIG. 19 illustrates a gain curve of the antenna module 100 in the frequency range of 22.5 GHz-45 GHz. Compared with the antenna module 100 illustrated in FIG. 16 according to the second implementation of the present disclosure, the antenna module 100 illustrated in FIG. 19 has a gain at the 40 GHz sideband which has increased by more than 1 dB (the gain of the antenna module 100 illustrated in FIG. 19 is about 4 dB and the gain of the antenna module 100 illustrated in FIG. 16 is about 3 dB).

In this implementation, the feeding trace layer coupled to the radio frequency port of the radio frequency chip 10 feeds the first antenna radiator 42 and the second antenna radiator 44 via the slot 32 of the ground layer 30, such that the first antenna radiator 42 generates a millimeter wave signal in the first frequency band and the second antenna radiator 44 generates a millimeter wave signal in the second frequency band, and a millimeter wave signal in a third frequency band is further generated by coupling the slot 32 and the stacked patch antenna 400 (i.e., the first antenna radiator 42 and the second antenna radiator 44), thereby achieving the single-feeding port dual-band radiation antenna, such that the antenna module 100 can cover a radiation band in a relatively large range and cover 5G millimeter wave frequency bands completely. With accordance to the protocol of the 3GPP 38.101, frequency bands for 5G NR are mainly separated into two different frequency ranges: frequency range 1 (FR1) and frequency range 2 (FR2). The FR1 band has a frequency range of 450 MHz-6 GHz, and also knows as the "sub-6 GHz" band. The FR2 band has a frequency range of 24.25 GHz-52.6 GHz, and also commonly known as millimeter wave (mmWave). 3GPP specifies that the 5G millimeter wave frequency bands include bands n257 (26.5 GHz-29.5 GHz), n258 (24.25 GHz-27.5 GHz), n261 (27.5 GHz-28.35 GHz), and n260 (37 GHz-40 GHz). The antenna module 100 provided by the implementations of the present disclosure supports the requirements of millimeter-wave full-band (26.5 GHz-29.5 GHz, 24.25 GHz-27.5 GHz, 27.5 GHz-28.35 GHz, and 37 GHz-40 GHz) in the 3GPP specifications.

In an implementation, the total thickness of the antenna module 100 is less than 0.8 mm, facilitating the implementation of the HDI process or the IC substrate process.

Figure 20:
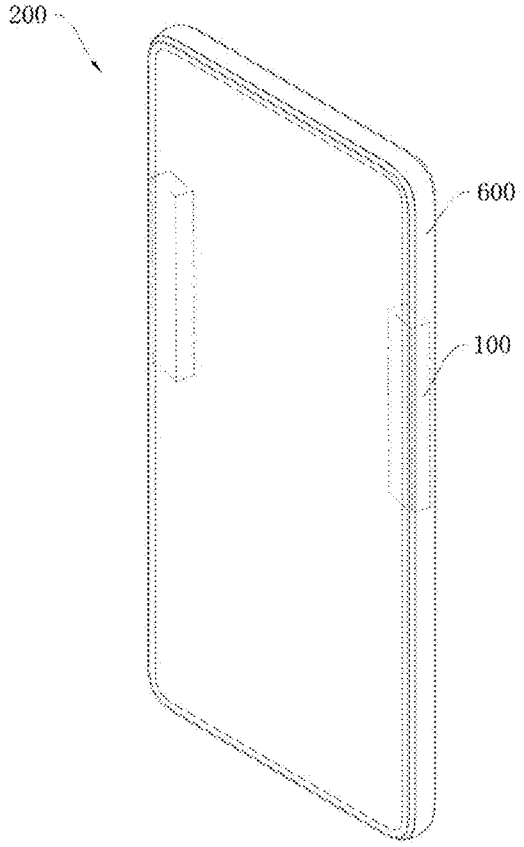
FIG. 20 is a schematic structural view illustrating an electronic device according to an implementation of the present disclosure.

Referring to FIG. 20, an electronic device 200 is further provided according to the implementations of the present disclosure. The electronic device 200 includes, but is not limited to, a mobile terminal such as a mobile phone, a tablet computer, and a notebook computer. The electronic device 200 provided by the implementations of the present disclosure includes a casing 600 and the antenna module 100 provided by the implementations of the present disclosure. The antenna module 100 is disposed within or on the casing 600. The antenna module 100 is used to radiate millimeter wave signals, such that the electronic device 200 can perform 5G signal communication. In this implementation, there may be one or more antenna modules 100 in the electronic device 200.

The above description are preferred implementations of the present disclosure, and it is surely that the protection scope of the present disclosure is not to be limited to the disclosed implementations. Those of ordinary skill in the art may understand and implement all or part of the processes in the above implementations, and equivalent variations made with accordance to the claims of the present disclosure still fall within the scope of the present disclosure.

What is claimed is:

1. An antenna module, comprising:

a dielectric substrate comprising a first surface and a second surface opposite the first surface;

a first insulating layer disposed on the first surface of the dielectric substrate;

a stacked patch antenna comprising a first antenna radiator disposed on a side of the first insulating layer away from the dielectric substrate, and a second antenna radiator disposed between the first insulating layer and the dielectric substrate, wherein a projection of the first antenna radiator on the dielectric substrate at least partially overlaps with a projection of the second antenna radiator on the dielectric substrate;

a ground layer disposed on the second surface of the dielectric substrate, wherein the ground layer defines at least one slot;

a second insulating layer disposed on a side of the ground layer away from the dielectric substrate; and a feeding structure disposed on a side of the second insulating layer away from the ground layer, wherein the feeding structure is configured to feed the stacked patch antenna via the at least one slot to excite the first antenna radiator to resonate in a first frequency band and excite the second antenna radiator to resonate in a second frequency band;

wherein the stacked patch antenna is configured to couple with the slot to resonate in a third frequency band.

2. The antenna module of claim 1, wherein the slot is offset from a geometric center of the ground layer.

3. The antenna module of claim 2, wherein the feeding structure comprises a radio frequency chip and a feeding trace coupled to a radio frequency port of the radio frequency chip, and an orthographic projection of the feeding trace on the ground layer is across the slot.

4. The antenna module of claim 3, wherein the slot is in a rectangular shape, and the feeding trace extends in a direction perpendicular to a longitudinal direction of the slot.

5. The antenna module of claim 3, wherein the slot comprises a first portion, a second portion, and a third portion, wherein the second portion and the third portion are in communication with the first portion respectively, the first portion is perpendicular to the second portion and the third portion respectively, and wherein the feeding trace extends in a direction perpendicular to the first portion of the slot.

6. The antenna module of claim 3, wherein the slot comprises a first portion, a second portion, and a connection portion connected between the first portion and the second portion, wherein the first portion and the second portion are different in size, and the connection portion is perpendicular to the first portion and the second portion respectively, and wherein the feeding trace extends in a direction perpendicular to the first portion and the second portion.

7. The antenna module of claim 6, wherein a length of the first portion is larger than that of the second portion, and a geometric center of the connection portion is offset from a geometric center of the first portion and a geometric center of the second portion.

8. The antenna module of claim 1, wherein an orthographic projection of the first antenna radiator on the ground layer at least partially overlaps with the slot, and an orthographic projection of the second antenna radiator on the ground layer at least partially overlaps with the slot.

9. The antenna module of claim 1, wherein the slot is adjacent to an orthographic projection of the first antenna radiator on the ground layer.

10. The antenna module of claim 1, wherein the first antenna radiator defines a first through hole extending through the first antenna radiator, and wherein a geometric center of the first through hole coincides with a geometric center of the first antenna radiator, and a cross section of the first antenna radiator and the first through hole are identical in shape.

11. The antenna module of claim 10, wherein a center of an orthographic projection of the second antenna radiator on the first antenna radiator coincides with the geometric center of the first through hole, and wherein an outer contour of the orthographic projection of the second antenna radiator on the first antenna radiator and the first through hole are identical in shape.

12. The antenna module of claim 11, wherein the second antenna radiator defines a second through hole extending through the second antenna radiator, wherein the second through hole has a circular shape, a square shape, or a cross shape, and wherein a geometric center of the second through hole coincides with a geometric center of the second antenna radiator.

13. The antenna module of claim 1, wherein a cross section of the first antenna radiator has an outer contour in a circular or rectangular shape, and a cross section of the second antenna radiator has an outer contour in a circular or rectangular shape.

14. The antenna module of claim 1, wherein the first frequency band comprises a millimeter wave frequency band with a center frequency of 28 GHz, the second frequency band comprises a millimeter wave frequency band with a center frequency of 39 GHz, and the third frequency band comprises a millimeter wave frequency band with a center frequency of 25 GHz.

15. An antenna module, comprising:

a dielectric substrate comprising a first surface and a second surface opposite the first surface;

a first insulating layer disposed on the first surface of the dielectric substrate;

a stacked patch antenna comprising a first antenna radiator disposed on a side of the first insulating layer away from the dielectric substrate, and a second antenna radiator disposed between the first insulating layer and the dielectric substrate, wherein a projection of the first antenna radiator on the dielectric substrate at least partially overlaps with a projection of the second antenna radiator on the dielectric substrate;

a ground layer disposed on the second surface of the dielectric substrate, wherein the ground layer defines at least one slot, the slot comprises a first portion, a second portion, and a connection portion connected between the first portion and the second portion, and the first portion and the second portion are different in size, and wherein the connection portion is perpendicular to the first portion and the second portion respectively;

a second insulating layer disposed on a side of the ground layer away from the dielectric substrate; and a feeding structure disposed on a side of the second insulating layer away from the ground layer, wherein the feeding structure has a feeding trace extending in a direction perpendicular to the first portion and the second portion, and wherein the feeding structure is configured to feed the stacked patch antenna via the at least one slot to enable the first antenna radiator to resonate in a first frequency band, a second frequency band, and a third frequency band.

16. The antenna module of claim 15, wherein the first frequency band comprises a millimeter wave frequency band with a center frequency of 28 GHz, the second frequency band comprises a millimeter wave frequency band with a center frequency of 39 GHz, and the third frequency band comprises a millimeter wave frequency band with a center frequency of 25 GHz.

17. An electronic device, comprising:

a casing; and an antenna module disposed within or on the casing;

wherein the antenna module comprises:

a dielectric substrate comprising a first surface and a second surface opposite the first surface;

a first insulating layer disposed on the first surface of the dielectric substrate;

a stacked patch antenna comprising a first antenna radiator disposed on a side of the first insulating layer away from the dielectric substrate, and a second antenna radiator disposed between the first insulating layer and the dielectric substrate, wherein a projection of the first antenna radiator on the dielectric substrate at least partially overlaps with a projection of the second antenna radiator on the dielectric substrate;

a ground layer disposed on the second surface of the dielectric substrate, wherein the ground layer defines at least one slot;

a second insulating layer disposed on a side of the ground layer away from the dielectric substrate; and a feeding structure disposed on a side of the second insulating layer away from the ground layer, wherein the feeding structure is configured to feed the stacked patch antenna via the at least one slot to excite the first antenna radiator to resonate in a first frequency band and excite the second antenna radiator to resonate in a second frequency band;

wherein the stacked patch antenna is configured to couple with the slot to resonate in a third frequency band.

18. The electronic device of claim 17, wherein the slot comprises a first portion, a second portion, and a third portion, wherein the second portion and the third portion are in communication with the first portion respectively, the first portion is perpendicular to the second portion and the third portion respectively, and wherein a feeding trace extends in a direction perpendicular to the first portion of the slot.

19. The electronic device of claim 17, wherein the slot comprises a first portion, a second portion, and a connection portion connected between the first portion and the second portion, wherein the first portion and the second portion are different in size, and the connection portion is perpendicular to the first portion and the second portion respectively, and wherein a feeding trace extends in a direction perpendicular to the first portion and the second portion.

* * * * *